US005670736A

United States Patent [19]

Chemiere et al.

[11] Patent Number: 5,670,736

[45] Date of Patent: Sep. 23, 1997

[54] PRIMING SYSTEM FOR THE EXPLOSIVE CHARGE OF A SUBMUNITION ON BOARD A CARRIER

[75] Inventors: Patrice Chemiere, La Chapelle Saint Ursin; Jean-Paul Dupuy, Bourges, both of France

[73] Assignee: Giat Industries, Versailles, France

[21] Appl. No.: 684,092

[22] Filed: Jul. 19, 1996

[30] Foreign Application Priority Data

Jul. 27, 1995 [FR] France ..... 95.09140

[51] Int. Cl.[6] ..... F42C 9/04

[52] U.S. Cl. ..... 102/254; 102/256; 102/266; 102/269

[58] Field of Search ..... 102/254–256, 102/266, 269, 393, 394

[56] References Cited

U.S. PATENT DOCUMENTS

| | | | |
|---|---|---|---|
| 3,985,079 | 10/1976 | Post et al. | 102/235 |
| 4,407,201 | 10/1983 | Jensen | 102/248 |
| 4,534,292 | 8/1985 | Weber et al. | 102/241 |
| 4,998,476 | 3/1991 | Rudenauer et al. | 102/226 |
| 5,016,532 | 5/1991 | Edminster | 102/254 |
| 5,048,419 | 9/1991 | Skowasch | 102/226 |
| 5,275,101 | 1/1994 | Chemiere et al. | 102/235 |
| 5,373,790 | 12/1994 | Chemiere et al. | 102/226 |
| 5,387,257 | 2/1995 | Tari et al. | 102/226 |
| 5,467,713 | 11/1995 | Roosmann et al. | 102/233 |

FOREIGN PATENT DOCUMENTS

| | | |
|---|---|---|
| 205956 | 12/1986 | European Pat. Off. . |
| 0 205 956 | 12/1986 | European Pat. Off. . |
| 0 284 923 | 10/1988 | European Pat. Off. . |
| 313995 | 5/1989 | European Pat. Off. . |
| 0 318 995 A2 | 6/1989 | European Pat. Off. . |
| 0 411 258 A2 | 2/1991 | European Pat. Off. . |
| 411258 | 2/1991 | European Pat. Off. . |
| 2650662 | 2/1991 | France . |
| 2 650 662 | 2/1991 | France . |
| 32 24 749 | 1/1984 | Germany . |

*Primary Examiner*—Michael J. Carone
*Assistant Examiner*—Matthew J. Lattig
*Attorney, Agent, or Firm*—Oliff & Berridge

[57] ABSTRACT

A priming system for the explosive charge of a sub-munition carried on board a carrier comprises a main firing pin, a primer tube operative to move from a safety position to an armed position, at least two devices to lock the primer tube in the safety position before the sub-munition is ejected, and a self-destruct mechanism operative to destroy the sub-munition after a predetermined delay. A first one of the locking devices is formed of a cam operative to move from a cam safety position, in which it forms a limit stop preventing the primer tube from passing freely into an armed position, to a retracted position in which it allows free passage of the primer tube. The cam carries an auxiliary firing pin to ignite a delay cord of the self-destruct mechanism. A second one of the locking devices engage the primer tube by the percussion tip of the firing pin to hold the primer tube in a safety position.

9 Claims, 3 Drawing Sheets

PRIMING SYSTEM FOR THE EXPLOSIVE CHARGE OF A SUBMUNITION ON BOARD A CARRIER

BACKGROUND OF THE INVENTION

The present invention relates to a priming system for an explosive charge of a sub-munition on board a carrier shell. The priming system comprises a main firing pin operative to translate, a mobile primer driven by a motor element from a safety position in which the primer is not aligned with the firing pin and the explosive charge to an armed position in which it is aligned therebetween, at least two devices to lock the primer in a safety position before the sub-munition is ejected, and a self-destruct device to destroy the sub-munition after a predetermined delay.

A conventional priming system is described in French patent publication document FR-A-2 650 662.

At the present time, priming systems for sub-munitions or bomblets scattered by a carrier have to satisfy certain safety conditions. One of these safety conditions concerns the locking devices which hold the primer in its safety position so as to avoid accidental ignition of the explosive charge during the loading and handling phases of the carrier before firing. Typically, they are fitted with a self-destruct mechanism to avoid polluting the area with live ammunition if a malfunction in the priming system of the sub-munitions occurs.

According to NATO standards, there must be at least two locking devices, generally of the centrifugal type. One is the motor element which enables the locks to be released that operates by the centrifugal forces which result from the spin imparted to the munitions upon scattering. This rotational movement itself is a result of the spin imparted to the carrier upon firing.

Another safety condition is the use of a self-destruct mechanism for sub-munitions. There are several conventional types of self-destruct mechanisms. One is a pyrotechnic delay composition housed in the primer tube. However, such a solution described in patents EP-A-318 995 and EP-A-411 258 is expensive and does not allow delays. Another is by an electronic delay housed in the primer tube. But this solution described in U.S. Pat. No. 5,387,257 is complicated, expensive and requires an additional electrical primer, a primable power source and means to unlock the electronic self-destruction mechanism. Yet another is a radial firing pin which is released further to the creep of a stressed pin. But this solution described in EP-A-205 956 is not reliable enough, mainly in its capacity to reproduce self-destruct times and to allow sufficiently long delay times. Another self-destruct mechanism is a delay cord notably described in French patent publication FR-A-2 650 662.

Generally, sub-munitions are fitted on board carriers such as cargo shells or artillery rockets. In the case of a cargo shell, the centrifugal forces are generally enough to ensure that the locking devices of the primer are released under the appropriate conditions and that the primer is able to move into its arming position. In addition, the sub-munitions scattered by a cargo shell have a flight time of approximately 15 seconds so that all the self-destruct mechanisms described previously can be used.

However, in the case of a rocket, the centrifugal forces are not always sufficient to ensure that the locking devices of the primer tube are released under the appropriate conditions. In addition, the sub-munitions scattered by a rocket have a flight time typically in excess of 30 secs, such that only those delays of the electronic or cord type enable a delay to be obtained which corresponds to the flight time.

SUMMARY OF THE INVENTION

An object of the invention is to design a priming system for sub-munitions or bomblets which is simple, easy to implement and able to provide a high degree of safety and good operational reliability of the locking devices of the primer tube and of the self-destruct mechanism. A sub-munition fitted with such a priming system is capable of being fired from either a shell or artillery rocket.

To this end, the invention proposes a locking system whereby one of the locking devices of the primer is formed of a movable cam driven by a cam motor element from a cam safety position to a retracted position. In the cam safety position, it forms a limit stop preventing the primer tube from passing freely into its armed position, in the retracted position 4 allows the free passage of the primer tube. Means to immobilize the cam in a cam safety position are provided which are released further to the ejection of the sub-munition in that the cam is fitted with an auxiliary firing pin which ignites a delay cord when the cam is in its retracted or percussion position after the sub-munition has been ejected.

According to another object of the invention, the cam, in its cam safety position, comprises a limit stop which is located in a manner to engages a finger integrally constructed with the primer tube to immobilize the primer tube in an intermediate safety position.

According to another object of the invention, the means to immobilize the cam in its safety position comprise a finger integral with the primer tube and which bears on another limit stop of the cam when the primer tube is itself in its safety position. This finger retracts as the primer tube moves towards its armed position.

The means to immobilize the cam in its cam safety position advantageously includes the body of an adjacent sub-munition on board the carrier.

Other conventional means to lock the primer tube in its safety position is forms with the main firing pin.

Generally, the motor element which enables the primer tube to move into its armed position, and the cam motor elements which enables the cam to move into its retracted or percussion position are formed of springs. It is possible that the movement of the motor element and cam motor element can be completed by the action of the centrifugal forces to which the sub-munitions are subjected.

Generally, the sub-munition comprises a body enclosing the explosive charge. The body is topped by the priming system which comprises a priming system body in which the firing pin, the primer tube and the cam are housed. According to another object of the invention, the delay cord of the self-destruct mechanism is wound around the priming system.

A sub-munition, fitted with a priming system according to the invention, can be fitted on board a cargo shell or an artillery rocket because the locking devices of the primer tube and the cam are not released by the centrifugal forces. Further, the self-destruct mechanism comprises a cord whose length can be adjusted during design to obtain delays which are compatible with the flight times of the sub-munitions which are longer for those which are scattered from an artillery rocket.

In addition, the primer tube of the priming system can be formed of a part able to rotate or slide, i.e., and translate.

BRIEF DESCRIPTION OF THE DRAWINGS

Other advantages, characteristics and particulars of the invention will become apparent from the detailed description which follows, made in reference to the appended drawings, given by way of illustration only, and in which.

DESCRIPTION OF THE PREFERRED EMBODIMENT

Figure 1:
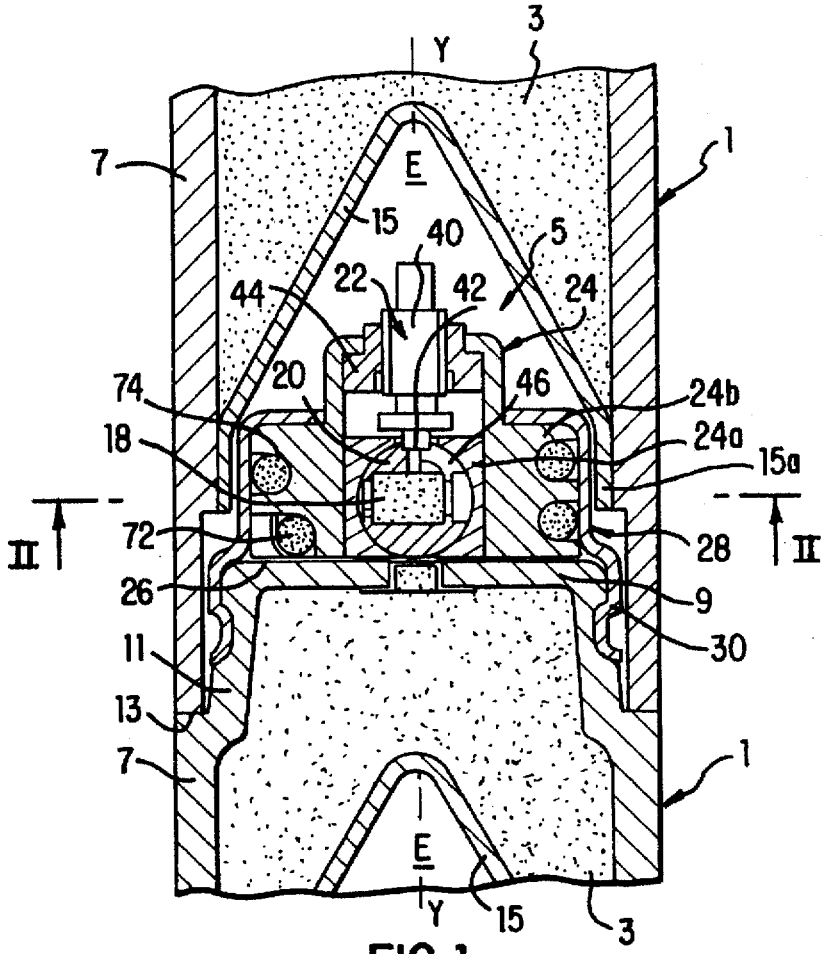
FIG. 1 is a partial longitudinal view in cross-section of two adjacent sub-munitions on board a carrier.

With reference to FIG. 1, a sub-munition 1 intended to be carried on board a carrier (not shown) encloses an explosive charge 3 which, after the sub-munition 1 has been ejected or scattered, is ignited by a priming system 5 in advance of the impact of the sub-munition 1 onto the ground or onto a target.

The sub-munition 1 comprises a metallic body 7, which is hollow and formed of a tubular shape. At one end, the body 7 is closed off by a bottom wall 9, forming a single unit with the body 7, and is topped by the priming system 5. To this end, the body 7 has a portion 11 of a reduced outer diameter which defines a ring-shaped shoulder 13 with the rest of the body 7.

The explosive charge 3 is shaped, that is it defines at the other open end of the body 7 of the sub-munition 1 an inner space E of a tapered shape which is covered with a charge liner 15 of a matching shape and completed with a circular skirt 15*a* made integral with the body 7.

In conventional a manner, several of these sub-munitions 1 are loaded into a carrier by being stacked on top of one another. This stacking is such that the priming system 5 and the reduced diameter portion 11 of the body 7 of one sub-munition are housed in the inner space E of the preceding sub-munition. With the loading direction of the sub-munitions, the shoulder 13 of the sub-munition 1 comes to bear on the adjacent end surface of the body 7 of the preceding sub-munition 1, as shown in FIG. 1.

The priming system 5 comprises a primer 18 carried by a primer tube 20, and a main firing pin 22. The primer tube 20 is mounted to translate (i.e. slide) or rotate in the body 24 of the priming system 5, so that it could move from a safety position in which the primer 18 is not aligned with the main firing pin 22 and the explosive charge 3, to an armed position in which this alignment has been made.

The body 24 of the priming system 5 is disposed around the bottom wall 9 of the body 7 of the sub-munition 1 and a disc 26 is placed between the body of the priming system 5 and the bottom wall 9. The body 24 is capped by a metallic shield 28 having a circular skirt 30. The skirt 30 is attached to the circumference of the reduced diameter portion 11 of the body 7 of the sub-munition 1 by crimping.

Figure 2:
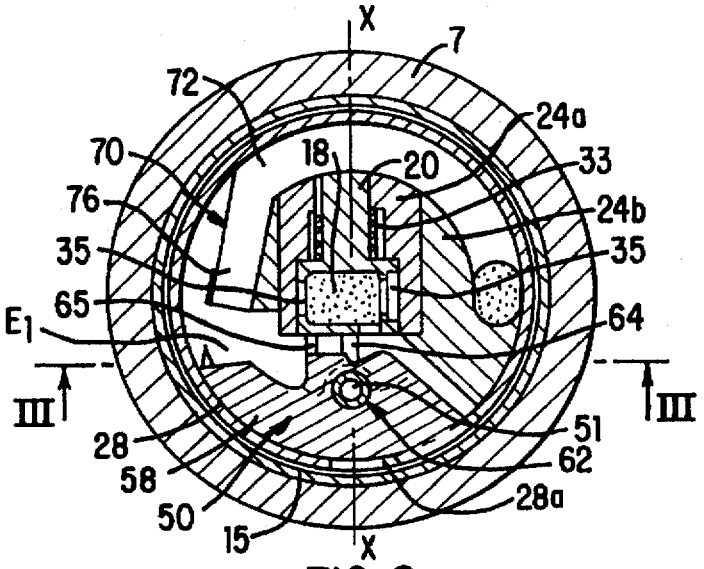
FIG. 2 is a cross-sectional view along line II—II in FIG. 1, the primer tube of the priming system of the sub-munitions being in its safety position.
Figure 3:
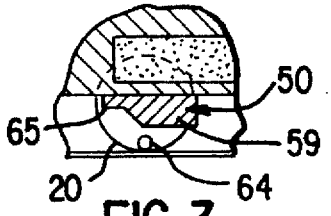
FIG. 3 is a partial cross-sectional view taken along line III—III in FIG. 2.
Figure 4:
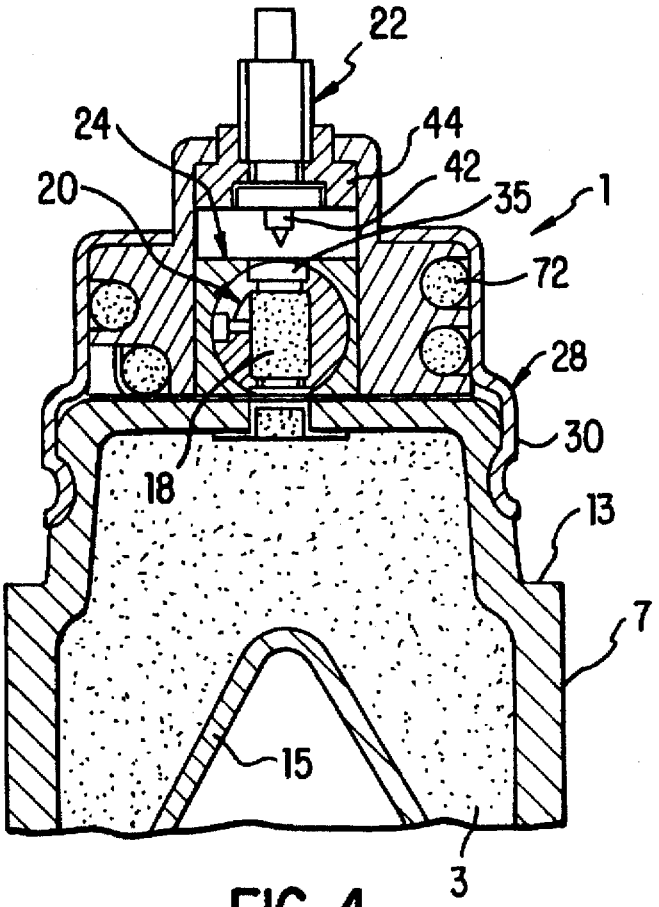
FIG. 4 is a similar view to that in FIG. 1 but where the primer tube is in its armed position.

With reference to FIG. 2, the body 24 of the priming system 5 comprises a first central part 24*a* which is partly surrounded by a second peripheral part 24*b*, which approximately comes into contact with the shield 28, so as to define a free inner space E1 between the body 24 and the shield 28.

In the example illustrated in the different Figures, the primer tube 20 is able to rotate and will hereafter be referred to as "drum 20".

The drum 20 is mounted in a housing in the central part 24*a* of the body 24, so as to be free to rotate around an axis X—X which is perpendicular to axis Y—Y of the sub-munition 1. The drum 20 cooperates with an arming spring 33 which forms the motor element to move the drum 20 into its armed position. The drum 20 comprises a housing which encloses the primer 18. The housing includes two diametrically opposed openings 35 that open to the outside thereof.

The main firing pin 22 comprises a cylindrical body 40 with a percussion tip 42 disposed at one end. The cylindrical body 40 is screwed onto a nut 44 mounted in the peripheral part 24*b* of the body 24, so that the cylindrical body 40 is aligned along axis Y—Y of the sub-munition opposite the drum 20.

The drum 20, armed by a spring 33, is held in its safety position by two locking devices.

With reference to FIG. 1, a first locking device is formed of the main firing pin 22. More specifically, during the assembly operations, the firing pin 22 is screwed into the nut 44 so as to engage by its percussion tip 42 a notch 46 provided on the periphery of the drum 20 to immobilize the latter in its safety position.

Figure 5:
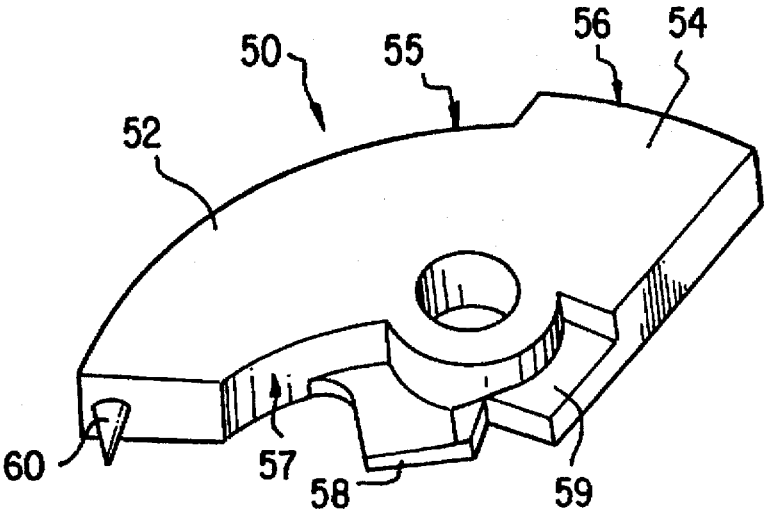
FIG. 5 is a perspective view of a cam which forms one of the locking devices for the primer tube in its armed position.
Figure 6:
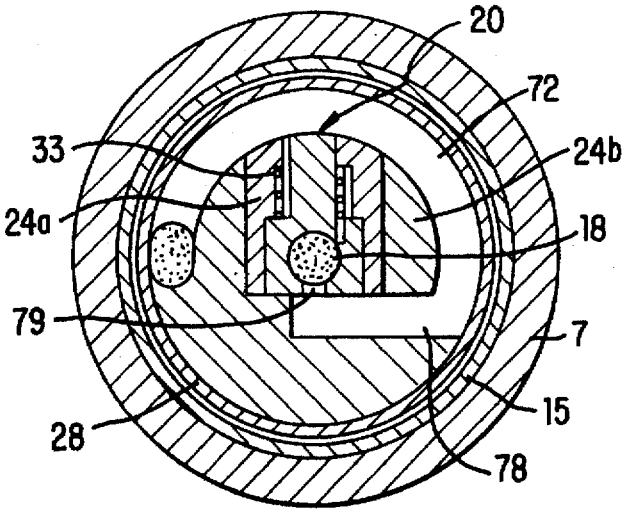
FIG. 6 is a cross-sectional view similar to that in FIG. 2 but where the primer tube is in its armed position.

The second device to lock the drum 20 in its safety position is formed by a cam 50. With reference to FIG. 5, the cam 50 is generally quarterly circular in shape with a front part 52 and a rear part 54. The profile of the outer edge 55 of the front part 52 is curved with a radius of curvature approximately the same as for the shield 28. The profile of the outer edge 56 of the rear part 54 is also curved, but with a slightly longer radius of curvature approximately the same as that of the skirt 15*a* of the charge liner 15. The profile of an inner edge 57 between the front part 52 and rear part 54 includes two notches which respectively define two limit stops 58 and 59. The end face of the front part 52 comprises an auxiliary firing pin 60 in a form of a tip.

With reference to FIG. 2, the cam 50 is mounted inside the inner space E1 disposed between the body 24 of the priming system 5 and the shield 28. The cam 50 is mounted for rotation around a fixed shank 51 parallel to axis Y—Y. The cam 50 is able to move from a safety position to a retracted position under the action of a motor element formed of an arming spring 62.

When the cam 50 is in its safety position, its cam limit stop 59 lies in the course of movement of a finger 64 integral with the drum 20. This limit stop 59 enables the drum 20 to be immobilized in an intermediate safety position if the first locking device formed by the main firing pin 22 is released before the sub-munition 1 has been scattered.

The cam 50 is immobilized in its safety position by two immobilizing devices.

The first immobilizing device for the cam 50 is formed of a finger 65 integral with the drum 20. This finger 65 bears on the limit stop 58 of the cam 50 when the drum 20 is in its cam safety position.

When the cam 50 is in its cam safety position, the outer edge 55 of its front part 52 is in contact with the inner wall of the shield 28, whereas the outer edge 56 of its rear part 54 lies opposite an opening 28*a* in the shield 28.

Figure 9:
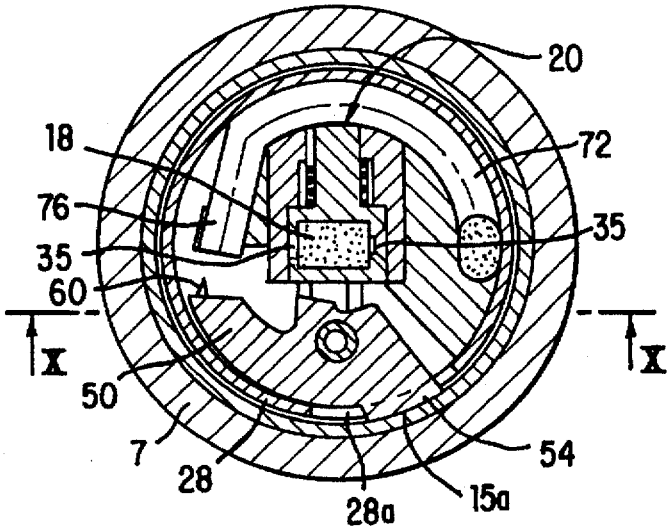
FIG. 9 is a partial cross-sectional view similar to that in FIG. 2 to illustrate one of the means to immobilize the cam in its safety position.
Figure 10:
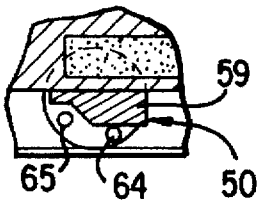
FIG. 10 is a partial cross-sectional view taken along line X—X in FIG. 9.

The second immobilizing device for the cam 50 is formed of a limit stop formed of the inner wall of the skirt 15*a* of the charge liner 15 of the adjacent sub-munition against which the outer edge 56 of the rear part 54 of the cam 50 comes into contact through the opening 28*a* of the shield 28, when the first immobilizing device for the cam 50 is released prior to the scattering of the sub-munition (FIGS. 9 and 10).

The priming system 5 is completed by a self-destruct mechanism 70 which is essentially formed of a delay cord 72 associated with the auxiliary firing pin 60.

The delay cord 72 is wound around the body 24 of the priming system 5, as shown in FIG. 1, a spiral shaped groove 74 being advantageously provided at the periphery of the body 24 to at least partially accommodate the delay cord 72. With reference to FIGS. 2 to 6, the cord 72 advantageously comprises, at one end, a percussion igniter relay 76 operative for ignition and, at the other end, a detonation relay 78 operative for the sympathetic detonation of the primer 18 through an opening 79 provided in the drum 20. In these circumstances, the self-destruct mechanism 70 is ignited by percussion of the igniter relay 76 by the auxiliary firing pin 60 carried by the cam 50 when the cam 50 reaches its retracted or percussion position.

The operation of the priming system 5 will now be described.

The parts forming the priming system 5 are assembled and attached to the body 7 of the sub-munition 1, such that the drum 20 and the cam 50 are in their respective safety positions, as illustrated in FIGS. 1 and 2.

More specifically, the main firing pin 22 is screwed in the nut 44 so that its percussion tip 42 engages in the notch 46 in the drum 20. The drum 20 armed by the spring 33 is in its safety position in which the two openings 35 of the drum 20 which communicate with the primer 18 are not axially aligned with the main firing pin 22 and the explosive charge 3 along axis Y—Y of the sub-munition 1.

The cam 50 is held in its cam safety position by a finger 65 of the drum 20 which bears on the limit stop 58 of the cam 50. In these circumstances, the outer edge 55 of the front part 52 of the cam 50 is approximately in contact with the shield 28 and the outer edge 56 of the rear part 54 of the cam 50 does not project outside the opening 28*a* in the shield 28.

It is noted that the safety positions of the drum 20 and the cam 50 are such that all accidents can be avoided during the handling of the sub-munitions, notably during the phase in which they are loaded into the carrier. Indeed, any handling or mishandling of the sub-munition is not likely to cause the main firing pin 22 to unscrew and with that the drum 20 held in its safety position, it also ensures that the cam 50 is held in its cam safety position to avoid the accidental ignition of the self-destruct mechanism by the auxiliary firing pin 60.

After the carrier has been fired and under normal operating conditions, the drum 20 and the cam 50 are held in their respective safety positions, as the acceleration and spin of the carrier do not normally have any influence on the drum 20 and the cam 50.

Upon expulsion, the sub-munitions 1 are scattered, and the drum 20 of the priming system 5 of one sub-munition 1 can only move into its armed position after the intervention of an element which stabilizes the trajectory, such as a band or parachute (not shown) and which is attached to the end of the main firing pin 22. The deployment of this stabilizing element causes a deceleration which, combined with the spin imparted to the sub-munition after it has been scattered, causes the main firing pin 22 to unscrew. Once the second locking device formed by the main firing pin 22 is released, the drum 20 moves under the action of its arming spring 33 into its armed position illustrated in FIG. 4. When the drum 20 starts to spin, its finger 65 is disengaged from the limit stop 58 of the cam 50. The effect is to release the cam which thus moves into its retracted position under the action of its arming spring 62. The auxiliary firing pin 60 then strikes the igniter relay 76 and the self-destruct mechanism 70 is ignited at a moment which corresponds to the passage of the drum 20 into its armed position.

Further to the sub-munition 1 impacting the ground or a target, the resulting deceleration causes the percussion of the primer 18 by the main firing pin 22. In the event of a malfunction, the primer 18 is ignited by the self-destruct mechanism 70 after a delay defined, in part, by the length of the cord 72.

If, further to the carrier being fired but before expulsion, the main firing pin 22 is subject to a translational movement such that it frees the drum 20, the latter moves into its armed position under the action of its arming spring 33. As the drum 20 starts to spin, its finger 65 disengages from the limit stop 58 of the cam 50, the effect of which is to release the cam 50 which begins to move into its retracted position under the action of its arming spring 62. However, the cam 50 can only undergo a restricted rotational movement as its rear part 54 will pass through the opening 28*a* of the shield 28 to come into contact with the charge liner 15 of the following sub-munition. Thus, the cam 50 is held in an intermediate safety position such that the spin of the drum 20 will be interrupted before the drum is able to reach its armed position. In fact, the finger 64 of the drum 20 will come into contact with the limit stop 59 of the cam 50, the effect of which is to interrupt the spin of the drum 20 which is thus held in an intermediate safety position (see FIGS. 9 and 10).

Figure 7:
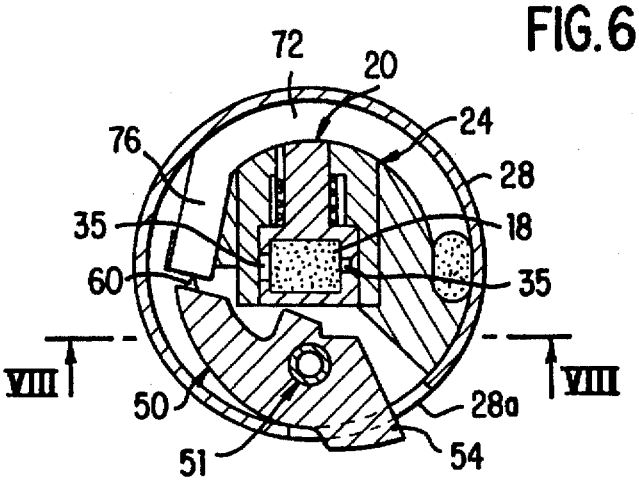
FIG. 7 is a cross-sectional view similar to that in FIG. 2 but where the cam has moved into a retracted or percussion position in which it strikes the delay cord of the self-destruct mechanism.
Figure 8:
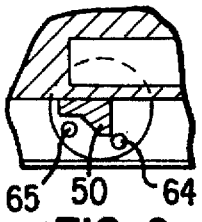
FIG. 8 is a partial cross-section view taken along line VIII—VIII in FIG. 7.

After the disengagement of the main firing pin 22, the cam 50 is released (FIGS. 7 and 8). In these circumstances, the drum 20 can move into its armed position and the cam 50 can move into its retracted or percussion position before the self-destruct mechanism 70 is ignited.

After the sub-munition 1 impacts the ground or a target, the main firing pin 22 ignites the primer and, in the event of a malfunction, the self-destruct mechanism 70 comes into play at the end of the delay determined, in part, by the length of the cord 72.

In the embodiment described above, the primer tube is able to rotate. As a variant, the characteristics of the priming system according to the invention also apply when the primer tube is able to translate (i.e. slide).

What is claimed is:

1. A priming system for an explosive charge of a sub-munition carried on board a carrier of a plurality of sub-munitions, comprising:

a main firing pin operative for translating;

a movable primer tube driven by a motor element from a safety position in which a primer is not aligned with the firing pin and the explosive charge to an armed position in which the primer is aligned with the firing pin and the explosive charge;

at least two locking devices for locking the primer tube in a safety position before the sub-munition is ejected from the carrier; and a self-destruct mechanism to destruct the sub-munition after a pre-determined delay whereby a first one of the locking devices is formed of a pivotally movable cam driven by a cam motor element from a cam safety position in which the first locking device forms a limit stop preventing the primer tube from moving into the armed position, to a retracted position allowing the primer tube to move into the armed position, the first locking device comprising means to immobilize the cam in the cam safety position, said means operative to release after the sub-munition is ejected from the carrier, the cam including an auxiliary firing pin which ignites a delay cord of the self-destruct mechanism when the cam is in the retracted position after the sub-munition has been ejected.

2. A priming system according to claim 1, wherein the cam, in the cam safety position, comprises a first limit stop disposed thereon in a manner to engage a first finger integrally constructed with the primer tube in order to immobilize the primer tube in an intermediate safety position.

3. A priming system according to claim 2, wherein the means to immobilize the cam in the cam safety position comprise a second finger integrally constructed with the primer tube which engages a second limit stop of the cam when the primer tube is in the safety position, the second finger operative to retracting at an onset of movement of the primer tube towards the armed position.

4. A priming system according to claim 1, wherein the means to immobilize the cam in the cam safety position cooperates with a body of an adjacent one of the sub-munitions on board the carrier.

5. A priming system according to claim 1, wherein the second locking device includes the main firing pin.

6. A priming system according to claim 1, wherein the motor element of the primer tube is a first spring and the cam motor element of the cam is a second spring.

7. A priming system according to claim 1, wherein the sub-munition comprises a body enclosing the explosive charge, said body being topped by the priming system, the priming system further comprising a priming system body in which the firing pin, the primer tube and the cam are housed, and in which the delay cord of the self-destruct mechanism is wound around the priming system body.

8. A priming system adaptable for use to ignite an explosive charge of a sub-munition placed on board a carrier, comprising:

a primer assembly including a housing containing a primer charge and movable from a safety position to an armed position, said housing initially and releasably disposed in the safety position yet resiliently biased towards the armed position;

a firing pin movable between an initial retaining condition whereby said firing pin releasably engages and retains said housing in the safety position to isolate the primer charge from said firing pin and the explosive charge and a primed condition whereby said firing pin releases said housing so that said housing can move from the safety position to the armed position wherein the primer charge is exposed to said firing pin and the explosive charge, said firing pin operative in the primed condition to cause detonation of the primer charge when said housing is in the armed position;

a self-destruct mechanism including an ignitable delay cord; and a cam pivotally movable from a cam safety position wherein said cam is releasably engaged with the primer assembly to a retracted position wherein said cam is released from said primer assembly to cause ignition of the delay cord, said cam initially and releasably disposed in the cam safety position yet resiliently biased towards the retracted position, so that when the sub-munition is ejected from the carrier, said cam can move to the retracted position to allow the housing to move to the armed position thereby priming said priming system for ignition of the explosive charge if said firing pin is in the primed condition.

9. A priming system according to claim 8, wherein said cam is operable to move to an intermediate cam safety position disposed between the cam safety position and the retracted position to retain said housing in an intermediate safety position disposed between the safety position and the armed position after-said firing pin moves from the retaining condition to the primed condition and before the sub-munition is ejected from the carrier.

* * * * *